United States Patent [19]

Norman et al.

[11] 4,012,656

[45] Mar. 15, 1977

[54] X-RAY TUBE

[76] Inventors: Ralph L. Norman, 3644 Marymont Drive NW., Huntsville, Ala. 35810; Jerry W. Hagood, 307 Mountain Gap Road SE., Huntsville, Ala. 35803; Joe Shelton, 700 Tatom St. NW., Huntsville, Ala. 35805

[22] Filed: Dec. 9, 1974

[21] Appl. No.: 530,893

[52] U.S. Cl. ..... 313/55; 313/309

[51] Int. Cl.[2] ..... H01J 35/00

[58] Field of Search ..... 313/55, 56, 57, 58, 313/309

[56] References Cited

UNITED STATES PATENTS

| | | | |
|---|---|---|---|
| 3,746,905 | 7/1973 | Shelton et al. | 313/309 |
| 3,783,325 | 1/1974 | Shelton | 313/336 |
| 3,883,760 | 5/1975 | Cunningham | 313/55 |

*Primary Examiner*—R. V. Rolinec
*Assistant Examiner*—Darwin R. Hostetter
*Attorney, Agent, or Firm*—Nathan Edelberg; Robert P. Gibson; Freddie M. Bush

[57] ABSTRACT

An improved x-ray tube uses the principle that sharp points emit electrons when subjected to sufficient electric fields enabling precision x-ray emission. A new oxide-metal composite material allows a uniform array of millions of electron emitting fibers to direct electrons toward a target anode. This emitting array allows intense bombardment of the tube target without the use of a thermal emitter.

5 Claims, 3 Drawing Figures

X-RAY TUBE

DEDICATORY CLAUSE

The invention described herein may be manufactured, used and licensed by or for the Government for governmental purposes without payment to us of any royalty thereon.

BACKGROUND OF THE INVENTION

There are many requirements for a variety of x-ray tubes. The target materials may be varied and the angular/electrical relationships in the tube may be varied to obtain the desired intensity and wavelength of x-ray emission. Useage ranges from delicate in vivo and in vitro animate tissue examination to massive industrial applications. The typical vacuum x-ray tube has a heated filament to furnish a supply of electrons which are accelerated by a very high voltage to an anode target. This target upon being struck by the high energy electrons emits x-rays. Heated filaments evaporate and grow less rigid with voltage increases; therefore, to prevent filament burnout lowered performance must be accepted or lifetimes are reduced.

Several types of x-ray tubes have been developed utilizing field effect emission. Generally, these types are some form of field effect emitter using either a single emitter or a low number of multiple array emitters which have been manually constructed, or the combination of a thermal emitter plus an intense electric field may be employed. Typical of prior art research programs in field emission is the work at Linfield College and Linfield Research Institute. Example reports are "Field Emission Cathode Ray Tube Development," by J. W. Griffith and W. W. Dolan of Linfield Research Institute, July 1958; and "Development of Field Emission Flash X-Ray Tubes and Devices" by W. P. Dyke et al, October 1961, Linfield Research Institute.

Current advances in the art of field effect electron emitters are set forth in U.S. Pat. Nos. 3,745,402 and 3,746,905 by Shelton et al and U.S. Pat. No. 3,783,325 by Shelton, co-inventors in the instant invention. The field effect electron emitter is an oxide-metal matrix comprised of ordered metal fibers separated by an insulating oxide. The emitter may be comprised of several million fibers arranged in parallel for each square centimeter of emitter surface area. The ends of the fibers form the emitting surface and are all substantially the same diameter with the distance between adjacent fiber ends being substantially the same.

SUMMARY OF THE INVENTION

An improved x-ray tube allows efficient x-ray emission to be obtained by utilizing a unique field-effect electron emitter, which may be readily shaped, in conjunction with the anode target. The field-effect emitter, an oxide-metal composite, may be mechanically shaped and chemically etched for directional electron emission toward the shaped target. The shaped target when bombarded by electrons, releases x-rays uniformly across the bombarded region enhancing tube performance and reducing excessive anode loading.

DESCRIPTION OF THE PREFERRED EMBODIMENT

The improved x-ray tube operates in a manner very similar to other hard vacuum x-ray tubes. However, a composite oxide-metal matrix material having several million emitting fibers per square centimeter allows the anode target to be bombarded from all sides and at selected angles for efficient x-ray emission. The oxide-metal composite, initially disclosed in U.S. Pat. No. 3,745,402 as having over a million emitting fibers per square centimeter, has currently been grown with as many as 10 million individual emitter fibers per square centimeter. Other field-effect emitters have been available in the prior art; however, their severe material limitations have prevented successful application in practical application. In the construction of an emitter by assembly of individual emitting needles as done in the prior art, the required electron capability is too limited. Also, non-uniformity of emitter rods in these prior art materials prevented a successful emitter being obtained beyond very limited power outputs. The oxide-metal composite emitter, which can be shaped both chemically and mechanically and assembled into large emitting arrays, allows readily shaped x-ray tube components for efficient x-ray emission.

Figure 1:
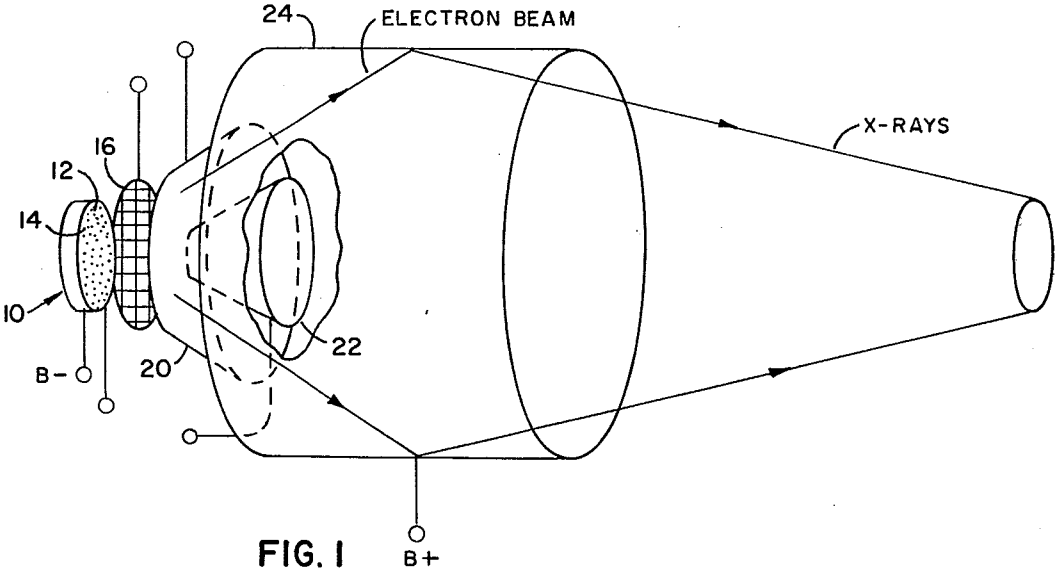
FIG. 1 is a simplified diagrammatic view of a preferred embodiment of the x-ray tube with the tube envelope and extraneous structure omitted.

As shown in FIG. 1 the arrangement of inter components of a large, high-intensity x-ray tube allows the primary x-ray beam intensity to be substantially directed to provide a uniform spot output. The components operate in a high vacuum sealed chamber (not shown) which may include a liquid used around the cylindrical target for cooling purposes.

An emitter 10 is composed of a high density oxide-metal composite material as previously disclosed by Shelton et al. A grid 12 is placed directly on the surface of the oxide of the composite as by vapor deposition or may be displaced from the surface immediately in front of it. A sufficient voltage placed on grid 12 causes metallic fibers 14 of the oxide-metal composite to emit electrons. Grid 16, which may actually be one or several parallel grids, is used for control of the electron beam and to suppress positively charged particles streaming back toward the emitter. Conical anodes 20 and 22 respectively are used to properly accelerate and focus the electron beam on a cylindrical target 24 which is positively charged in relation to emitter 10. The electron beam from emitter 10 is controlled to strike the cylindrical target in such a manner as to obtain the maximum usable x-ray output in accordance with the well established Sommerfeld's formula. The x-ray output may be masked to further convert it to a more useful beam, allowing only the x-ray emission at a given angle with respect to the bombarding electrons to pass through the mask. The Sommerfeld's formula, $$I(\Theta)\, d\,\Omega = A^2 \frac{\sin^2 \Theta}{\cos \Theta} \left[ \frac{1}{(1-\beta \cos \Theta)^4} - 1 \right] d\,\Omega,$$

is an approximation of the x-ray directional intensity at substantially 90° to the electron beam. As the anode target voltage increases the intensity normal to the electron beam decreases. Sommerfeld's formula is well established and defined in the prior art and is disclosed in the cited prior art hereinabove.

In operation, appropriate operating voltages are applied to the respective electrodes to control the emission of electrons from emitter 10 toward cylindrical target anode 24. Obviously these voltages may vary depending on the anode voltage 24 to be used and the spot intensity output desired. The operating potentials are established to hold operation of the tube off until the control voltage supplied to control grid 12 is increased to initiate field-effect emission. Emission is terminated by reducing or removing the control grid voltage.

Figure 2:
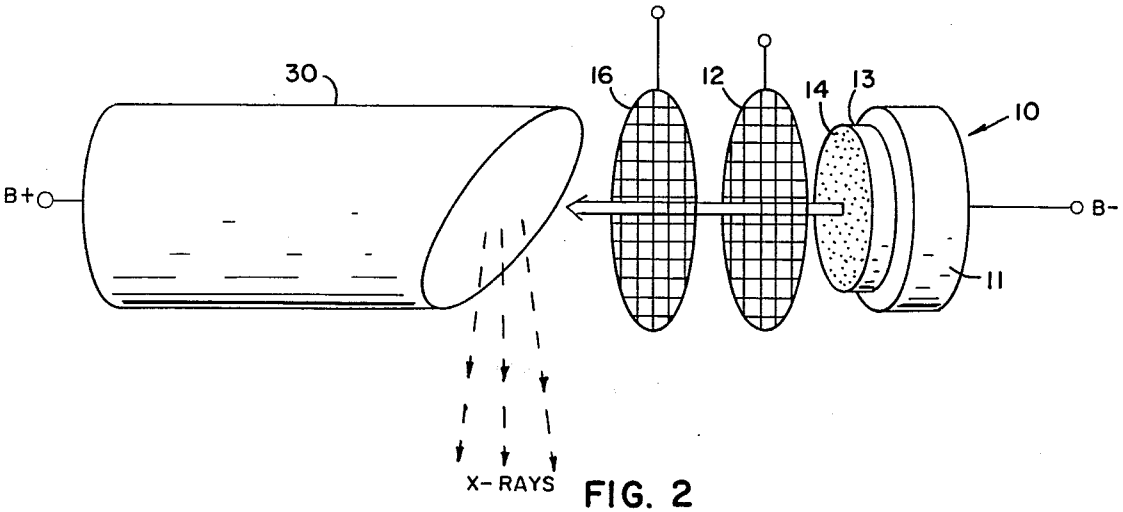
FIG. 2 is a diagrammatic view of another preferred embodiment of the x-ray tube with extraneous structure omitted.

FIG. 2 discloses a second component layout for a more conventionally shaped x-ray tube. This tube operates in the same manner as the tube shown in FIG. 1 and may also employ additional grids and electrodes 16 to shape and accelerate the electron beam. The field-effect emitter 10 is shown in more detail to have a conductive backing plate 11 and an oxide-metal composite 13 having several million parallel emitting fibers 14 therein. The characteristics of the emitter are such that it may be shaped and electrically or magnetically focused to take great advantage of a small electron beam target area approximating a point source. Control grid 12 provides the on-off field-effect emission control and serves to accelerate an electron beam toward the target 30. Impact of the electrons releases x-ray substantially normal to the beam path.

Figure 3:
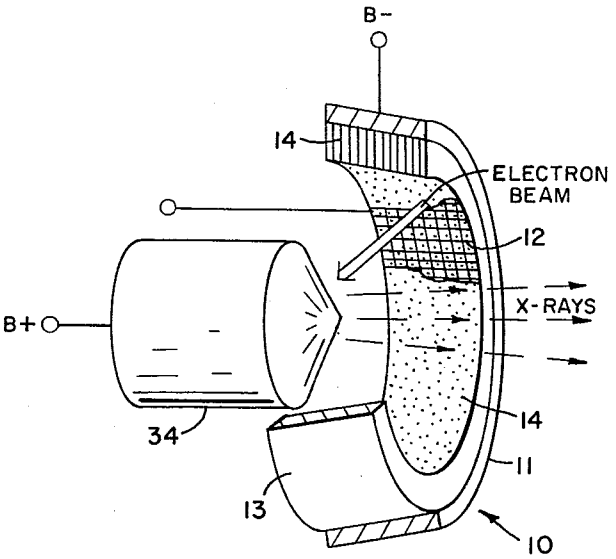
FIG. 3 is a diagrammatic view of the x-ray tube using a cylindrical field-effect emitter with the tube envelope and related extraneous structure omitted.

FIG. 3 shows a particular structure or configuration which tends to maximize Sommerfeld's formula to take advantage of the major x-ray output lobe. This configuration takes advantage of the processibility of the oxide-metal composite to form emitter 10 into a uniform cylindrical shape. The conductive backing plate 11 is on the outer surface of cylinderical emitter 10 with the oxide metal composite 13 adjacent thereto and the accelerating control grid 12 deposited on the inner surface thereof. A target anode 34 has a conical point projecting within the cylindrical ring emitter along the longitudinal axis thereof for receiving electron beam bombardment from around the inner annular surface of the emitter, with resulting x-rays being directed substantially along the longitudinal axis.

Since the improved x-ray tube involves no heated tungsten which can migrate to the electron target it has the advantage of spectrum purity. Having no heated filament the tube also has the advantage of not failing due to development of gas from a hot, gas-evolving, evaporating filament, resulting in a longer lifetime under more diverse operating conditions. Since the tube depends on electrons emitted under only field-effect emission and not thermal emission, it will be more easily controlled since the parameter of voltage will completely control current flow and is suitable to high voltage operation. The material from which this field-effect emitter is fashioned allows the emitter to be shaped in any desired configuration and yet maintain great uniformity from one emitting rod to the next. The device may be designed to have enormous x-ray output intensity since the electron emitter involves several millon, uniformily arranged emitting rods per square centimeter.

Preferred embodiments of the invention have been chosen for purposes of illustration and description. These embodiments illustrated are not intended to be exhaustive nor to limit the invention due to precise forms disclosed. They are chosen and described in order to best explain the principles of the invention and the application thereof in practical use to thereby enable others skilled in the art to best utilize the invention in various embodiments and modifications as are best adapted to the particular use contemplated. It will be apparent to those skilled in the art that changes may be made in the form of the structure disclosed without departing from the spirit of invention as set forth in the disclosure. It is therefore, to be understood that within the scope of the appended claims, the invention may be practiced otherwise than as specifically described. Accordingly it is desired that the scope of the invention be limited only by the claims appended hereto.

We claim:

1. In an x-ray tube for generating x-ray emission, the improvement comprising: a composite field-effect electron emitter having several million insulated emitting fibers per square centimeter of emitter surface with adjacent fibers being substantially in parallel and disposed for emitting an electron beam at prevailing ambient temperatures; a target anode disposed for electron bombardment by said emitter and for releasing x-ray in response to said electron bombardment; and a control grid disposed adjacent said emitter fibers between said emitter and said target anode for varying an electric field between said emitter and said anode and thereby control field-effect electron emission; said emitter being shaped in conjunction with the shape of said anode for stimulating directional x-radiation uniformly across the anode region of bombardment.

2. In an x-ray tube as set forth in claim 1 the improvement wherein said control grid is a vapor deposited conductive film on the insulated surface portion of said emitter.

3. In a x-ray tube for generating x-ray emission as set forth in claim 1 wherein said anode is a cylindrical target for receiving electron bombardment around the inner annular surface thereof, said emitter is disposed adjacent one end of and coaxially aligned with said cylinder; and further comprising a conical accelerating anode disposed between said emitter and said target for accelerating electrons released from said emitter, and a conical focusing anode disposed within said accelerating anode for directing the electron beam toward said cylindrical target.

4. An x-ray tube for generating x-ray emission as set forth in claim 1 wherein said anode target has a flat surface disposed to direct x-ray emissions in a substantially normal direction to that of the bombarding electron beam.

5. An x-ray tube as set forth in claim 1 wherein said field-effect emitter is a cylindrical segment having an oxide-metal composite inner annular surface with electron emitting ends of said fibers terminating around the inner circumference of said segment and said target anode is a conical surface coaxial with and within said cylinder for emitting x-ray substantially axially away from said anode when bombarded with electrons from said emitter.

* * * * *